US010597268B2

(12) United States Patent
Curtis

(10) Patent No.: US 10,597,268 B2
(45) Date of Patent: Mar. 24, 2020

(54) JACK STAND APPARATUS AND METHOD

(71) Applicant: William P. Curtis, Woodstock, IL (US)

(72) Inventor: William P. Curtis, Woodstock, IL (US)

( * ) Notice: Subject to any disclaimer, the term of this patent is extended or adjusted under 35 U.S.C. 154(b) by 1 day.

(21) Appl. No.: 15/496,186

(22) Filed: Apr. 25, 2017

(65) Prior Publication Data

US 2017/0320713 A1 Nov. 9, 2017

Related U.S. Application Data

(60) Provisional application No. 62/327,406, filed on Apr. 25, 2016.

(51) Int. Cl.

| | |
|---|---|
| ***B66F 1/06*** | (2006.01) |
| ***B66F 13/00*** | (2006.01) |
| ***B66F 3/10*** | (2006.01) |
| ***B66F 3/08*** | (2006.01) |
| ***B66F 3/14*** | (2006.01) |

(52) U.S. Cl.

CPC ..... *B66F 3/10* (2013.01); *B66F 3/08* (2013.01); *B66F 3/14* (2013.01)

(58) Field of Classification Search

CPC .... E21D 15/24; B66F 3/10; B66F 1/06; B66F 3/08; B66F 1/00; B66F 13/00; F16M 11/24; F16M 11/046; F16M 11/18

USPC .... 254/98, 85, 8 B, 126, 108, 352; 248/352, 248/676, 354.5; 269/212–214

See application file for complete search history.

(56) References Cited

U.S. PATENT DOCUMENTS

| | | | | | |
|---|---|---|---|---|---|
| 1,785,069 | A | * | 12/1930 | Boudette | B66F 3/08 254/98 |
| 2,097,949 | A | * | 11/1937 | Johnson | B66F 1/06 254/111 |
| 2,179,577 | A | * | 11/1939 | Lucker | B66F 1/06 254/111 |
| 2,213,672 | A | * | 9/1940 | Johnson | B66F 1/06 254/108 |
| 3,314,655 | A | * | 4/1967 | Steele | B66F 3/10 254/92 |
| 5,180,131 | A | * | 1/1993 | Few | F16M 11/046 248/352 |

(Continued)

FOREIGN PATENT DOCUMENTS

GB 190714338 * 5/1907

*Primary Examiner* — Monica S Carter
*Assistant Examiner* — Mahdi H Nejad
(74) *Attorney, Agent, or Firm* — Christopher J. Scott

(57) ABSTRACT

A jack stand apparatus enables operators to screw adjust a load support column relative to a column support base for fully completing load-bearing distances between loads and opposed support surfacing, and thus improving safety of jack stand applications. The various embodiments of the jack stand apparatus according to the present invention may all be said to comprise a shaft support structure, a shaft construction, a pawl assembly, and a screw mechanism. In the preferred embodiment, the shaft construction is a screw type element and includes external threads. A pawl element is cooperable with the external threads, and the screw shaft construction is telescopically positionable relative to the shaft support structure for engaging an overlying load. The pawl element is engagable with the helical threads for preventing downward movement of the screw shaft construction relative to the shaft support structure for supporting loads thereupon.

7 Claims, 14 Drawing Sheets

(56) References Cited

U.S. PATENT DOCUMENTS 5,297,779 A * 3/1994 Collins, Jr. ..... B66F 3/08
254/98
7,383,922 B1 * 6/2008 Richey ..... B66B 9/025
182/148

* cited by examiner

JACK STAND APPARATUS AND METHOD

PRIOR HISTORY

This patent application is a non-provisional patent application claiming the benefit of U.S. Provisional Patent Application No. 62/327,406 filed in the United States Patent and Trademark Office on 25 Apr. 2016, the specifications and drawings of which are hereby incorporated by reference thereto.

INVENTION SUMMARY

State of the art jack stands do not allow for discrepancies in variations of structures requiring jack support as exemplified by a vehicular frame or vehicular axle or support surfaces such as garage or shop floors and the like. This shortcoming very often results in a vehicle that is poorly supported by state of the art jack stands, the load tending to rock off of three points. Needless to say, a poorly supported load is a safety hazard. Further, when state of art jack stands are lowered or collapsed, the support shaft often slams down when the pawl is released from the ratchet teeth resulting in possible damage to the jack stand, for example, in the form of stress fractures to the equipment.

The jack stand apparatus and associated methodology according to the present invention are designed with a view toward remedying these shortcomings by allowing the user to position the jack stand support mast at any required elevation thereby structurally addressing structural variances in overlying vehicular frames or elements and/or underlying support surfaces. The jack stand apparatus according to the present invention allows the user to fully complete the load-bearing distance between a load and a support surface. Further, preloading the jack stand apparatus according to the present invention eliminates the stress caused by support column freefall and collisions with the support surface. The operator can also ensure the stand is secure before undoing the support attributable to the jack stand apparatus.

To achieve these basic objectives, the jack stand apparatus according to the present invention supports loads place thereupon and provides an enhanced method for incrementally closing support gaps by providing a screw-type support shaft for enhancing a user's ability to stabilize loads as supported by a number of the jack stand apparatuses operating in tandem with one another. The various embodiments of the jack stand apparatus according to the present invention may all be said to comprise a shaft support structure, a shaft construction, a pawl assembly, and a screw mechanism.

In the preferred embodiment, the shaft support structure comprises a series of leg elements and a central shaft-receiving post or hub. The series of leg structures extend radially from the central shaft-receiving post or hub, which central shaft-receiving hub comprises a shaft-receiving bore. The shaft construction of the preferred embodiment is a screw shaft construction and thus is rotatably received in the shaft-receiving bore, comprising a shaft axis of rotation and external helical threads. The external helical threads comprise a shaft thread pitch.

The preferred pawl assembly is cooperably associated with the shaft support structure and the screw shaft construction, and comprises a fulcrum, a lever arm, and a pawl element. The pawl element comprises a helical tip, which helical tip comprises a pawl pitch equal to the shaft thread pitch. The screw shaft construction is telescopically positionable relative to the shaft-receiving hub for engaging an overlying load. The helical tip is engagable with the helical threads for preventing downward movement of the screw shaft construction relative to the shaft support structure for supporting loads thereupon.

The central screw shaft construction is rotatable about the axis of rotation such that the helical tip, when engaged with the external threads, converts rotational movement into linear movement of the screw shaft construction relative to the helical tip for finely adjusting the length of exposed screw shaft relative to the shaft support structure for enhancing structural engagement with an overlying load interface or for fully completing the load bearing distance between an overlying load and an underlying support surface.

BRIEF DESCRIPTION OF THE DRAWINGS

Other objects of the present invention, as well as particular features, elements, and advantages thereof, will be elucidated or become apparent from, the following brief descriptions of drawing figures submitted in support of these specifications.

DETAILED DESCRIPTION OF THE PREFERRED EMBODIMENTS

Referencing the drawings now with more specificity, the present invention firstly and basically provides a jack stand apparatus in a number of embodiments for more properly and/or safely supporting loads placed thereupon. As noted hereinabove, state of the art jack stands 14 as generically depicted and referenced in FIGS. 1, 1A, 1B, and 3 do not allow for discrepancies in variations of structures requiring jack support as exemplified by a vehicular framing or vehicular wheel-axle assemblies 12 or uneven support surfaces such as garage or shop floors and the like as at 11.

Figure 1:
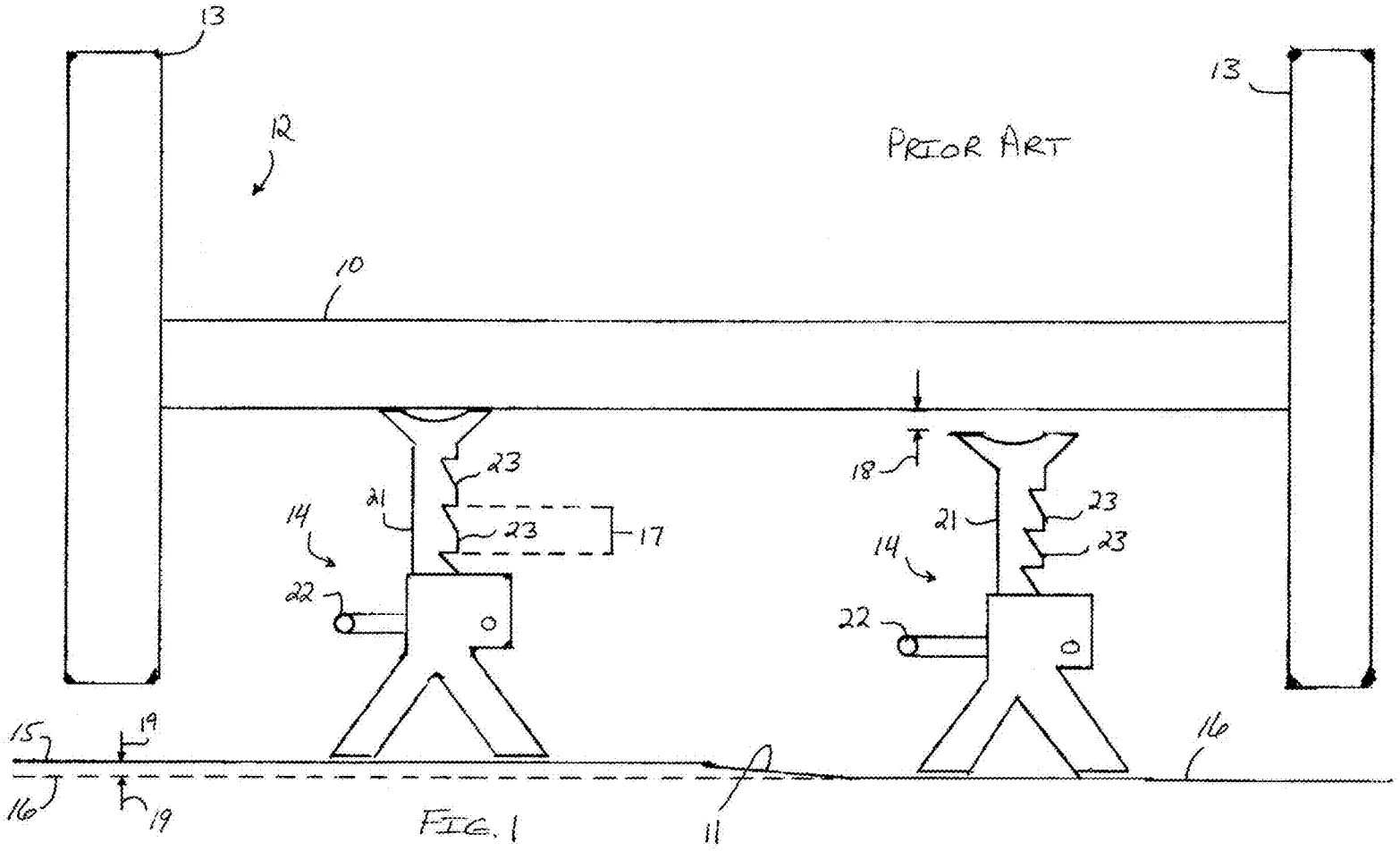
FIG. 1 is a diagrammatic depiction of a prior art jack stand support arrangement showing first and second prior art jack stand assemblies positioned in inferior adjacency to a wheel-axle assembly and showing an uneven support surface, the base of the first prior art jack stand being positioned atop the uneven support surface at a first elevation and the base of the second prior art jack stand being positioned atop the uneven support surface at a second elevation, the first prior art jack stand assembly fully completing the load bearing distance between the overlying wheel-axle assembly and the underlying uneven support surface, and the second prior art jack stand assembly being unable to fully complete the load bearing distance between the overlying wheel-axle assembly and the underlying uneven support surface.
Figure 1A:
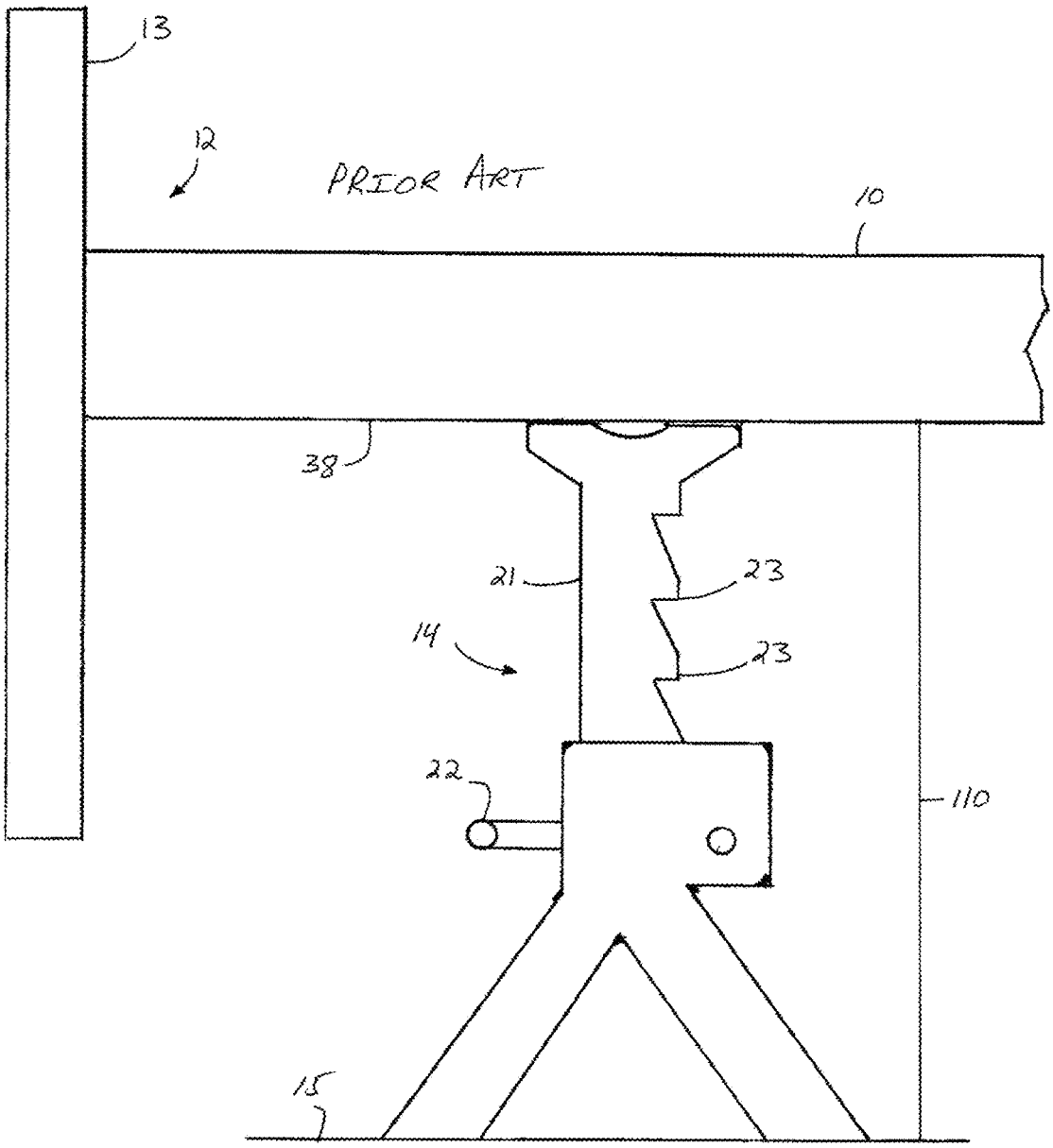
FIG. 1A is a diagrammatic depiction of a portion of the prior art jack stand support arrangement otherwise depicted in FIG. 1 showing the first prior art jack stand assembly positioned in inferior adjacency to the wheel-axle assembly to show with greater clarity the base of the first prior art jack stand being positioned atop the uneven support surface at the first elevation.
Figure 1B:
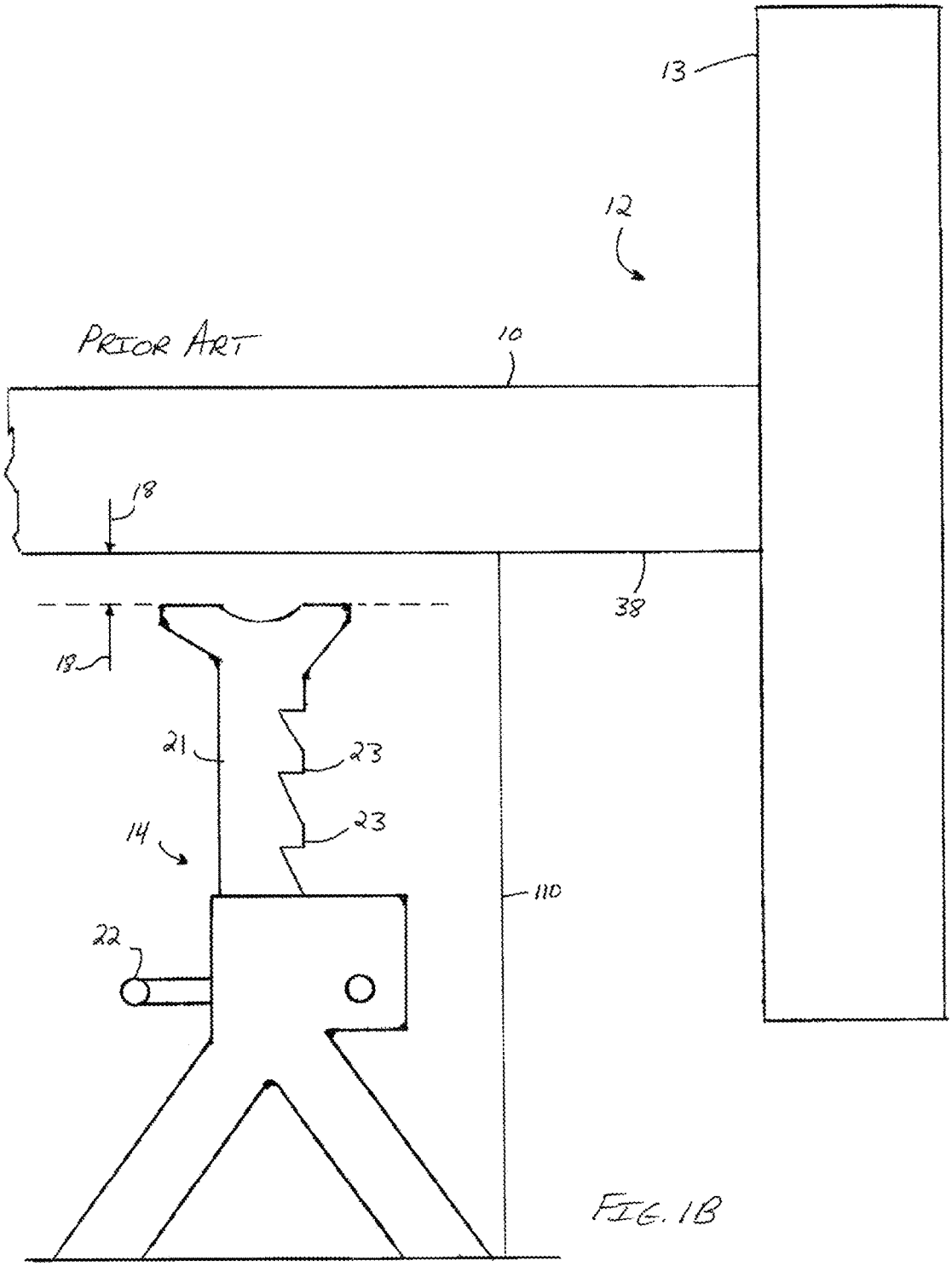
FIG. 1B is a diagrammatic depiction of a portion of the prior art jack stand support arrangement otherwise depicted in FIG. 1 showing the second prior art jack stand assembly positioned in inferior adjacency to the wheel-axle assembly to show with greater clarity the base of the second prior art jack stand being positioned atop the uneven support surface at the second elevation.
Figure 2:
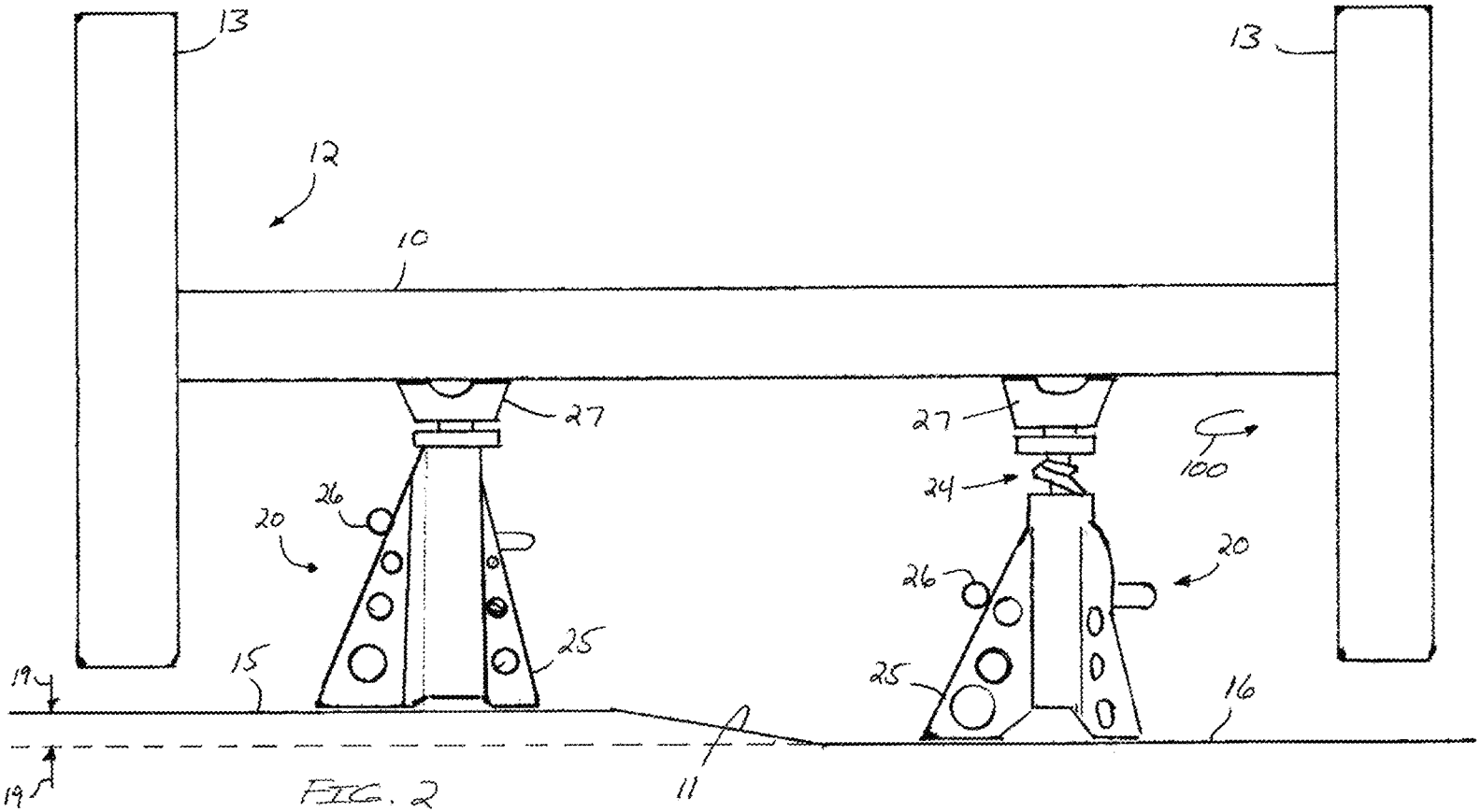
FIG. 2 is a diagrammatic depiction of a jack stand support arrangement according to the present invention showing first and second prior art jack stand assemblies positioned in inferior adjacency to a wheel-axle assembly and showing an uneven support surface, the base of the first jack stand being positioned atop the uneven support surface at a first elevation and the base of the second jack stand being positioned atop the uneven support surface at a second elevation, both the first and second jack stand assemblies fully completing the load bearing distance between the overlying wheel-axle assembly and the underlying uneven support surface.
Figure 2A:
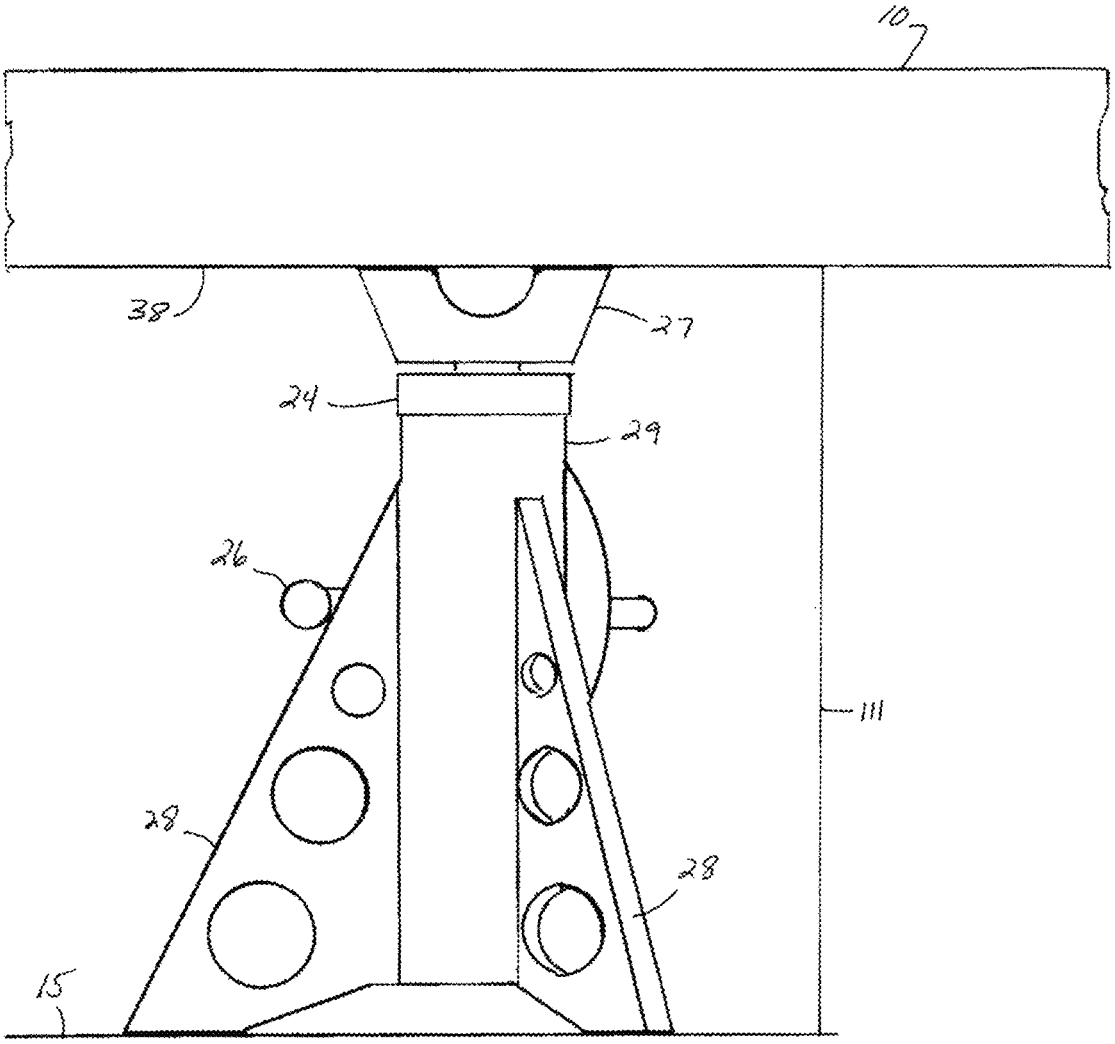
FIG. 2A is a diagrammatic depiction of a portion of the jack stand support arrangement otherwise depicted in FIG. 2 showing the first prior art jack stand assembly positioned in inferior adjacency to the wheel-axle assembly to show with greater clarity the base of the first jack stand being positioned atop the uneven support surface at the first elevation.

A generic wheel-axle assembly is generally depicted and referenced at 12 with wheels being depicted at 13 and the vehicular axe being depicted at 10. An uneven support surface 11 is exemplified is generally and comparatively depicted in FIGS. 1 and 2 showing a first support surface elevation as at 15 and a second support elevation as at 16 with the difference in elevation being referenced at 19. A standard ratchet tooth-to-tooth distance is depicted and referenced at 17. The reader will note that the support plane-to-axle distance or gap 18 in FIGS. 1 and 1B is less than the tooth-to-tooth distance 17, and, in view of the elevational difference 19, said distance or gap 18 is of such a magnitude that the static tooth-to-tooth distance 17 renders an uneven support system or arrangement given state of the art jack stands 14.

In other words, the distance 110 between the support surface 11 to the underside 38 of the load typified by the wheel-axle assembly 12 may be varied. State of the art jack stands 14 limit the user's ability to adequately support loads by limiting distance changes to tooth-to-tooth distance 17 increments or multiples. Since the tooth-to-tooth distance 17 will not always equal the gap distance 18 as typified by a differences in support-sited elevations at the support surface 11, state of the jack stands 14 fall short of meeting maximized safety standards. This shortcoming very often results in a poorly supported vehicle or a vehicle supported by state of the art jack stands 14 that rock off of three points or are otherwise unstable thereby creating a significant safety hazard.

The safety hazard of an unstable, poorly (prior art jack stand apparatus) supported vehicle is exacerbated by the propensity for state of art jack stands 14 to unexpectedly collapse such that the state of the art masts or central support columns 21 fall under their own weight when the support pawl assemblies 22 are released from the ratchet teeth 23 resulting in possible damage to the jack stand 14 such as a stress fracture(s) when colliding with the underlying support surfacing. The preferred jack stand apparatus 20 according to the present invention is designed with a view toward remedying these shortcomings by allowing the user to screw-position the support structure or interface element 27 at any required elevation relative to the support base 25 thereby structurally addressing structural variances in vehicular frames or elements and/or support surfaces as at uneven support surface 11.

Figure 2B:
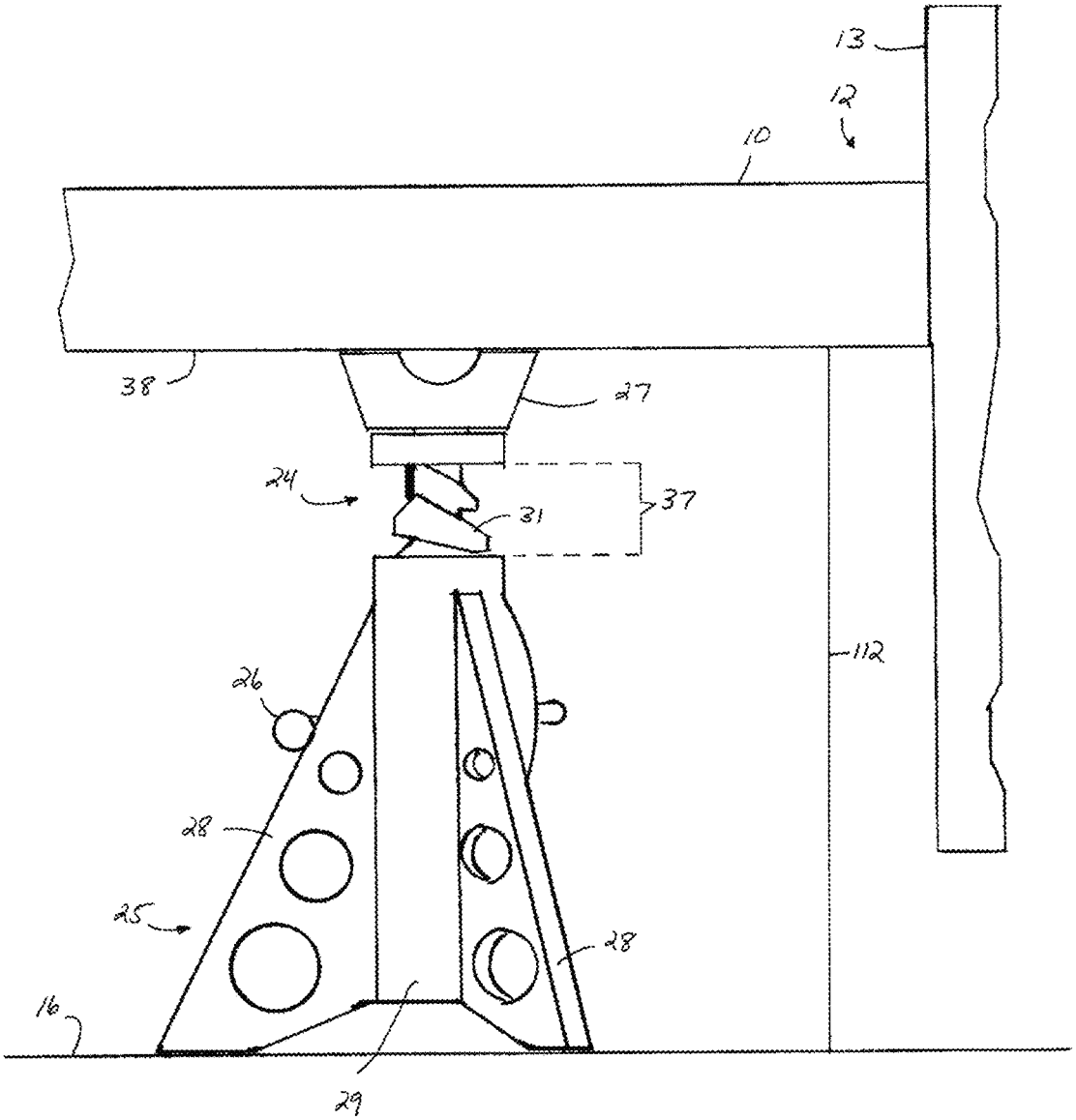
FIG. 2B is a diagrammatic depiction of a portion of the jack stand support arrangement otherwise depicted in FIG. 2 showing the second jack stand assembly positioned in inferior adjacency to the wheel-axle assembly to show with greater clarity the base of the second jack stand being positioned atop the uneven support surface at the second elevation with a screw-adjustable exposed support shaft portion that fully completes the load-bearing distance between the overlying wheel-axle assembly and the underlying support surface at the second elevation.
Figure 3:
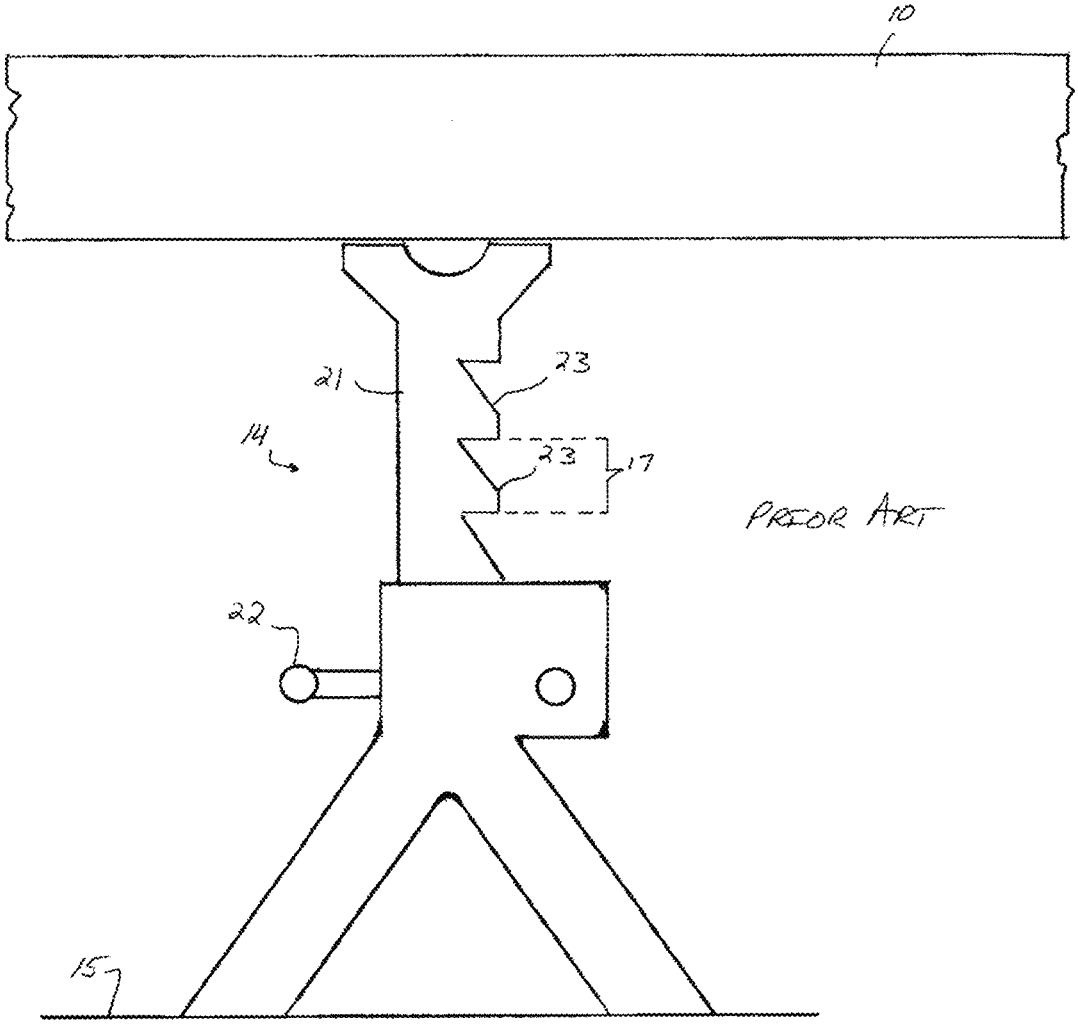
FIG. 3 is an elevational side diagrammatic depiction of a prior art jack stand support arrangement showing a prior art jack stand assembly positioned in inferior adjacency to a wheel-axle assembly to show the base of the prior art jack stand being positioned atop a support surface and in an assembly-support position and highlighting a fixed tooth-to-tooth distance of the ratcheted mast or support column of the prior art jack stand.
Figure 4:
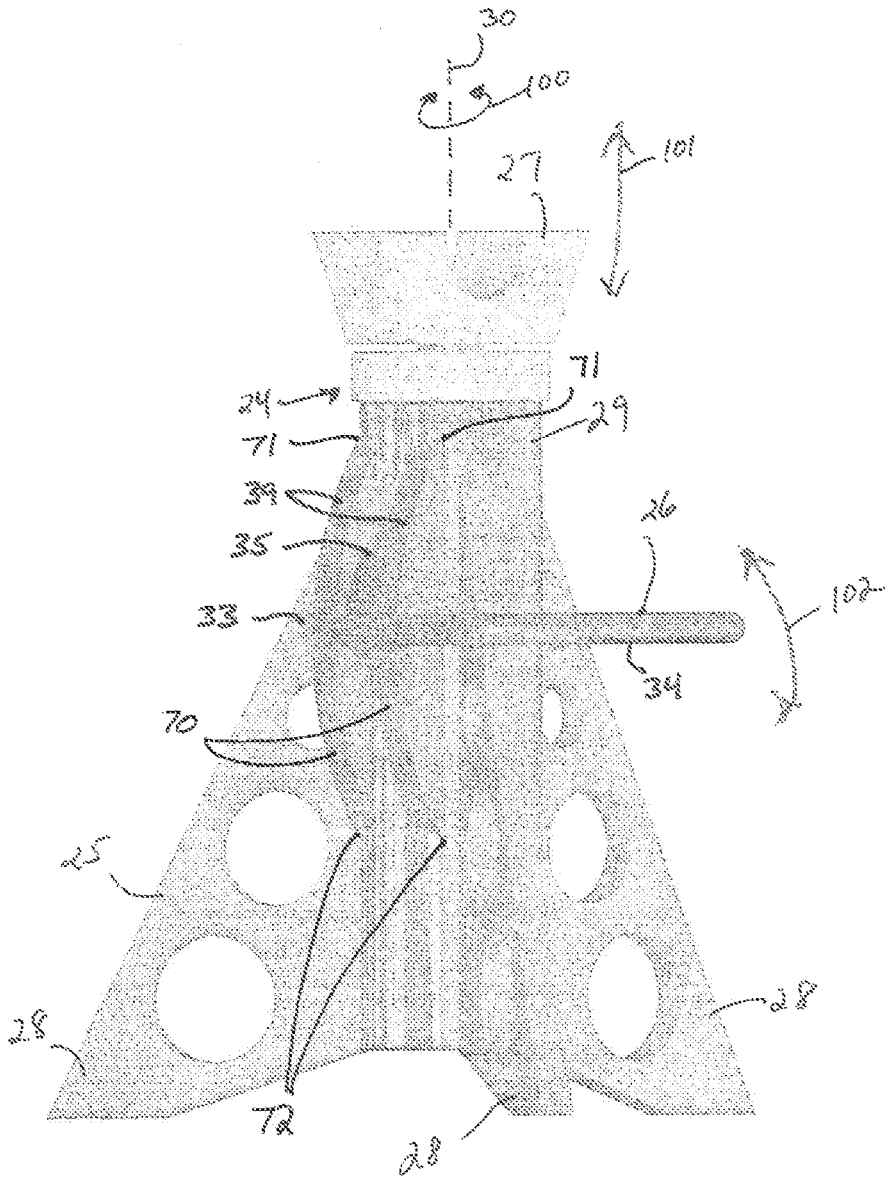
FIG. 4 is a side perspective depiction of a first alternative jack stand support arrangement according to the present invention showing a series of arrows to highlight directional movement of various elements of the jack stand apparatus to effect jack stand support capability according to the present invention.

To achieve these basic objectives, the first alternative or preferred jack stand apparatus 20 according to the present invention supports loads place thereupon as exemplified by the wheel-axle assembly 12, and provides an enhanced method for incrementally closing or eliminating support device to load gap(s) 18 by providing a screw-type support shaft or construction 24 for enhancing a user's ability to stabilize loads as supported by a number of the jack stand apparatuses 20 operating in tandem with one another. Comparing FIGS. 2-2B, the reader will see that distance 111 is equal to distance 112 less distance 37, which distance 37 is enabled by screw operation according to the present invention. The first alternative jack stand apparatus 20 according to the present invention may be said to comprise a shaft support structure or base as at 25, a screw shaft construction as at 24, and a pawl assembly as at 26 for achieving this screw operation.

The shaft support structure 25 preferably comprises a series of leg elements 28, a central shaft-receiving post or hub as at 29, and opposed fulcrum support elements as at 39. The series of leg elements or structures 28 preferably extend radially outwardly from the central shaft-receiving post or hub 29, which central shaft-receiving post or hub 29 comprises a shaft-receiving bore. The series of leg elements 28 preferably number three for forming a tripod type arrangement and enhancing support and maintaining stability of the loads supported by the jack stand apparatus. The opposed fulcrum support elements 39 extend outwardly from the central shaft-receiving hub 29 between two leg elements 28.

The opposed fulcrum support elements 39 each preferably comprise an arcuate outer fulcrum support element surface as at 70 extending from an upper point 71 of the central shaft-receiving hub 29 in inferior adjacency to the overlying load interface element 27 to a lower point 72 of the central shaft-receiving hub 29, the lower point(s) being located intermediate the length of the two leg elements 28 of the series of leg elements 28. The screw shaft construction 24 is rotatably received in the shaft-receiving bore and comprises a shaft axis of rotation 30 and external helical threads as at 31. The external helical threads 31 preferably comprise a shaft thread pitch as at 32.

Figure 5A:
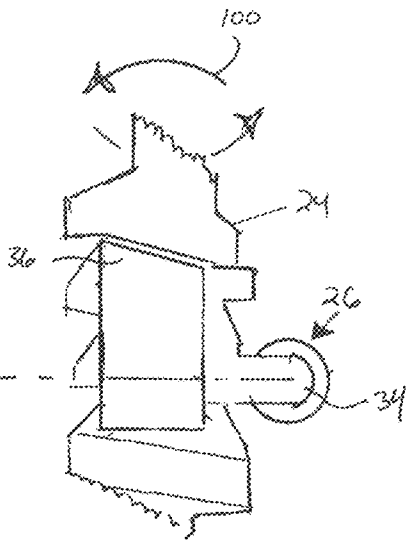
FIG. 5A is a fragmentary view as fragmented and rotated from FIG. 5 to show the helical tip portion of the pawl assembly in engagement with the external thread structure of the first alternative screw shaft construction from a view 90 rotational degrees from the view shown in FIG. 5.
Figure 5:
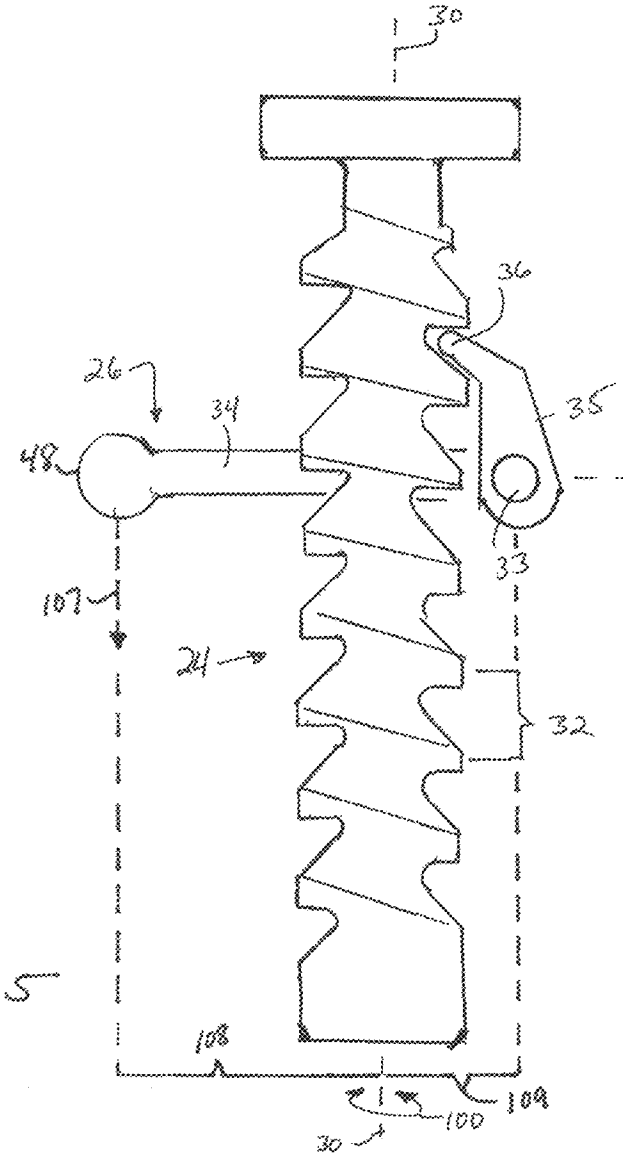
FIG. 5 is a side perspective depiction of a first alternative screw shaft construction and pawl assembly according to the present invention showing a helical tip portion of the pawl assembly in engagement with the external thread structure of the first alternative screw shaft construction.
Figure 6:
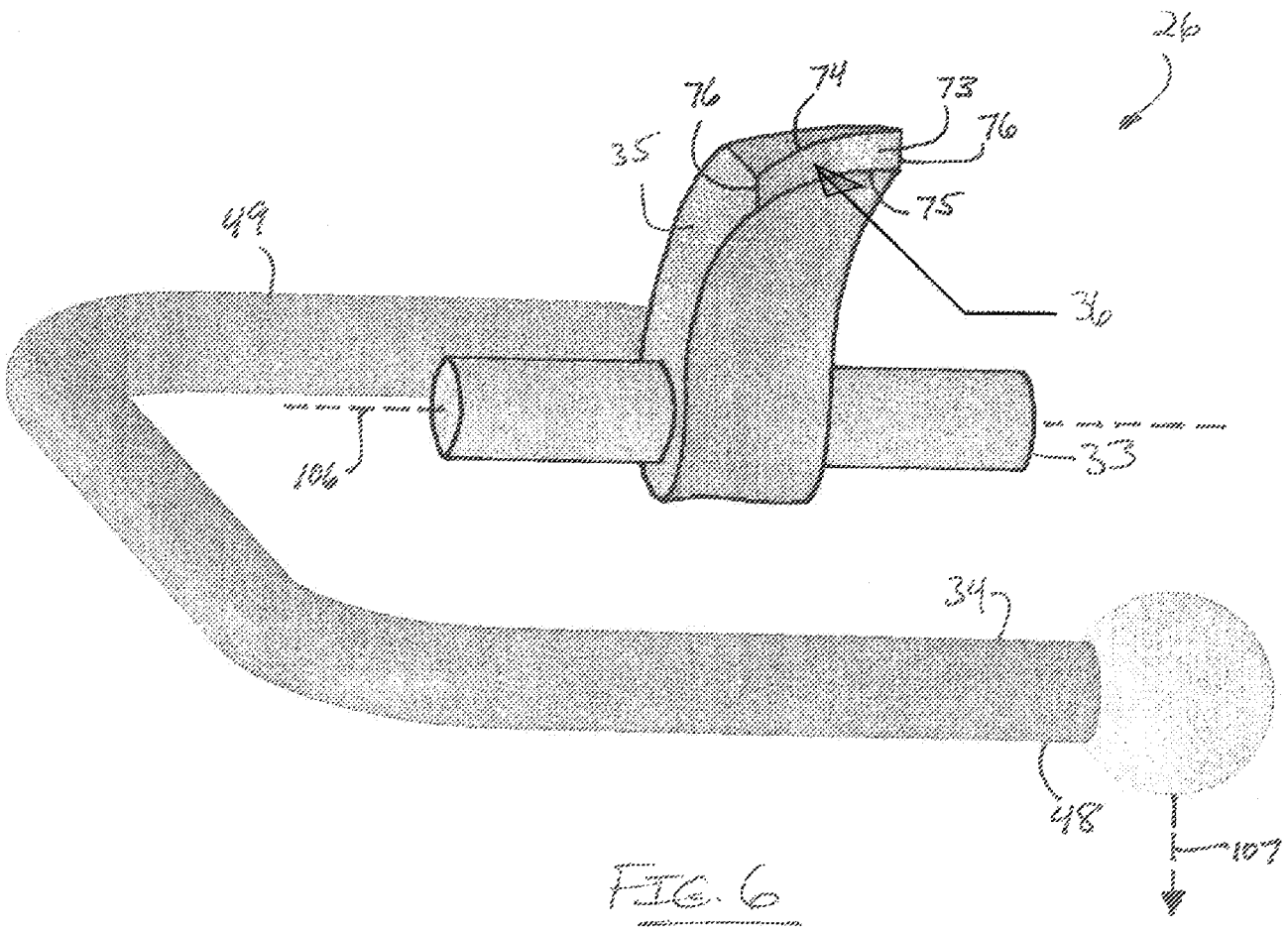
FIG. 6 is a perspective depiction of a first alternative pawl assembly according to the present invention highlighting the helical tip portion of the pawl element of the first alternative pawl assembly.

The pawl assembly 26 is cooperably associated with the shaft support structure 24 and the screw shaft construction 24, and comprises a fulcrum 33, a lever arm 34, and a pawl element 35. The lever arm 34 and the pawl element 35 extend from the fulcrum 33 as generally depicted in FIGS. 5 and 6. The fulcrum 33 has a fulcrum axis of rotation as at 106. The fulcrum 33 is rotatably supported by the opposed fulcrum support elements 39 equidistant intermediate the upper point(s) 71 of the central shaft-receiving hub 29 and the lower point(s) 72 of the central shaft-receiving hub 29 for enabling the user to structurally cooperate the pawl element 35 with the external helical threads 31 via the lever arm 34.

The lever arm 34 preferably comprises an outer arm portion 48 extending on an opposite side of the screw shaft construction 24 relative to the pawl element 35. The outer arm portion 48 comprises an arm weight as at 107 for directing the pawl element 35 into engagement with the external threads 31. In this regard, the lever arm 34 preferably comprises parallel arm portions extending on opposite sides of the fulcrum 33. The outer arm portion 48 is a first parallel arm portion of the parallel arm portions and is spaced from the screw shaft construction 24 a distance 108 greater than a distance 109 of an inner arm portion 49 from the screw shaft construction 24, which inner arm portion 49 is a second parallel arm portion of the parallel arm portions.

The pawl element 35 comprises a helical pawl tip 36, which helical pawl tip 36 comprises a pawl pitch equal to or otherwise cooperable with the shaft thread pitch 32. The helical pawl tip 36 further preferably comprises a flat pawl tip face as at 73, a helical upper pawl tip edge as at 74, a helical lower pawl tip edge as at 75, and laterally opposed pawl tip edges as at 76. The helical upper and lower pawl tip edges 74 and 75 are preferably parallel to one another, and the laterally opposed pawl tip edges 76 being parallel to one another.

The pawl element 35 extends intermediate the opposed fulcrum support elements 39 for enabling the user to structurally cooperate the helical pawl tip 36 with the external helical threads 31 via the lever arm 34. The screw shaft construction 24 is telescopically positionable relative to the shaft-receiving hub structure 29 for engaging an overlying load as exemplified by the wheel-axle assembly 12. The helical pawl tip 36 is engagable with the external helical threads 31 for preventing downward movement of the screw shaft construction 24 relative to the shaft support structure 25 when so engaged.

The central screw shaft construction 24 is rotatable as at 100 about the axis of rotation 30 such that the helical tip 36, when engaged with the external threads 31, converts rotational movement 100 into linear movement 101 of the screw shaft construction 24 relative to the helical tip 36 and the shaft support structure 25 for finely adjusting the length of exposed screw shaft (as at distance 37) relative to the shaft support structure 25 for enhancing structural engagement with an overlying load interface (e.g. the underside 38 of the wheel-axle assembly 12). The pawl assembly 26 may be further engaged and disengaged with the screw shaft construction 24 via pivotal movement 102 thereof about the fulcrum 33 via the lever arm 34.

Figure 7:
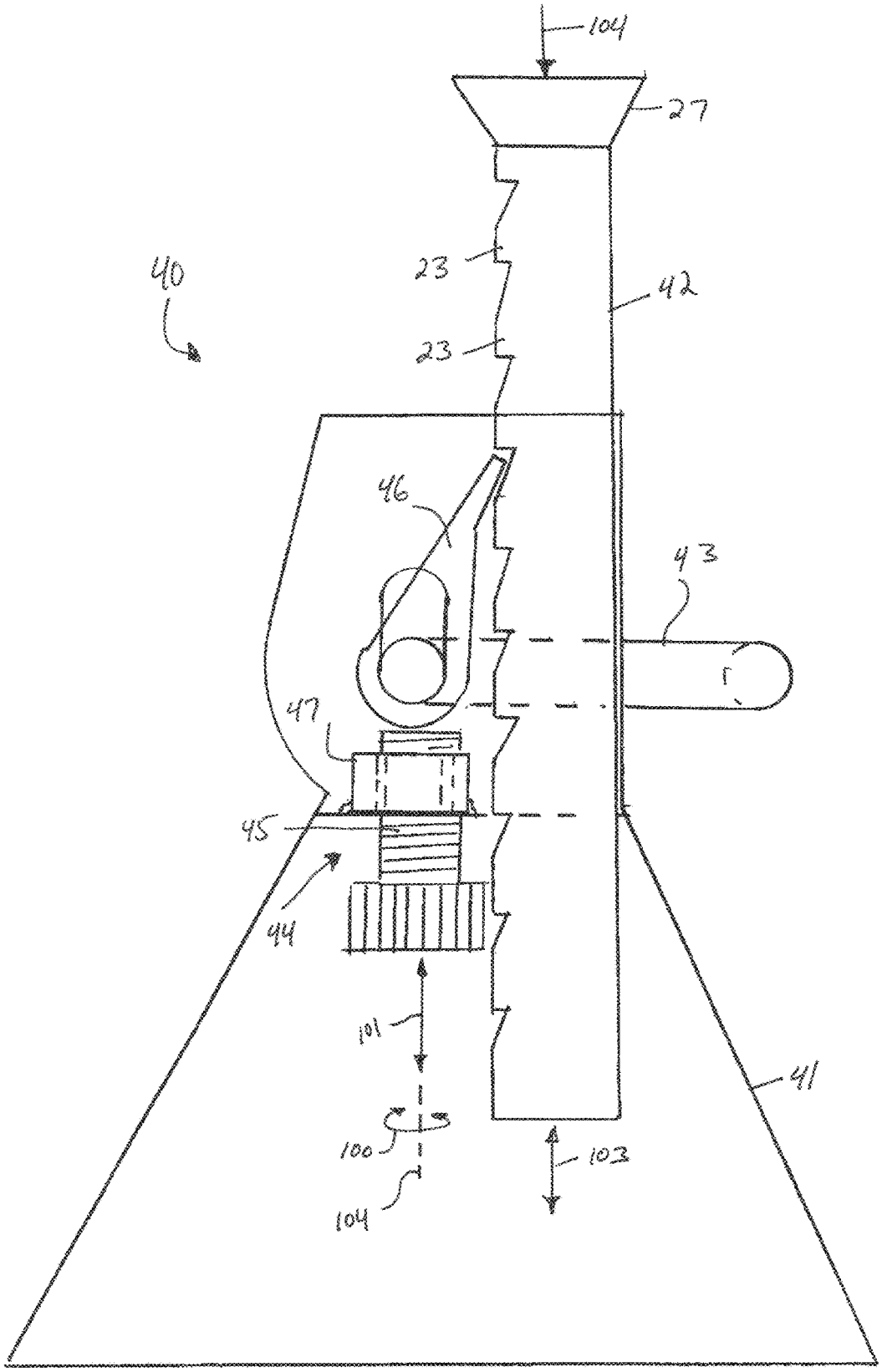
FIG. 7 is an elevational side diagrammatic depiction of a second alternative jack stand apparatus according to the present invention showing a second alternative screw mechanism in combination with a second alternative latch pawl assembly together being operable to enable the user to screw-adjust the second alternative latch pawl assembly via the second alternative screw mechanism to raise or lower a state of the art ratcheted support column or mast relative to a generic support base.

A second alternative jack stand apparatus 40 according to the present invention is generally depicted in FIG. 7. Jack stand apparatus 40 may be said to comprise a shaft support structure or base as at 41, a ratcheted shaft construction as at 42, a pawl assembly as at 43, and a screw assembly as at 44. The screw assembly 44 is operable to convert rotational motion 100 of the screw element 45 of the screw assembly or mechanism 44 into linear motion 101 directed into the pawl assembly 43 and thus into the shaft construction 42 via a pawl element 46 of the pawl assembly 43.

The linearly directed force similarly and finely raises or lowers (as at 103) said shaft construction 42 into and out of engagement with an overlying load 104 as exemplified by the wheel-axle assembly 12. It will be understood from an inspection of FIG. 7 that the screw mechanism 44 operates to direct linear motion into the pawl assembly 43 in a vertical direction. The screw axis of rotation as at 104 extends in parallel relation to the axis of the ratcheted shaft construction 42 and is cooperable with a horizontally anchored, internally threaded member 47 positioned in adjacency to both the ratcheted shaft construction 42 and the pawl element 46.

Figure 8:
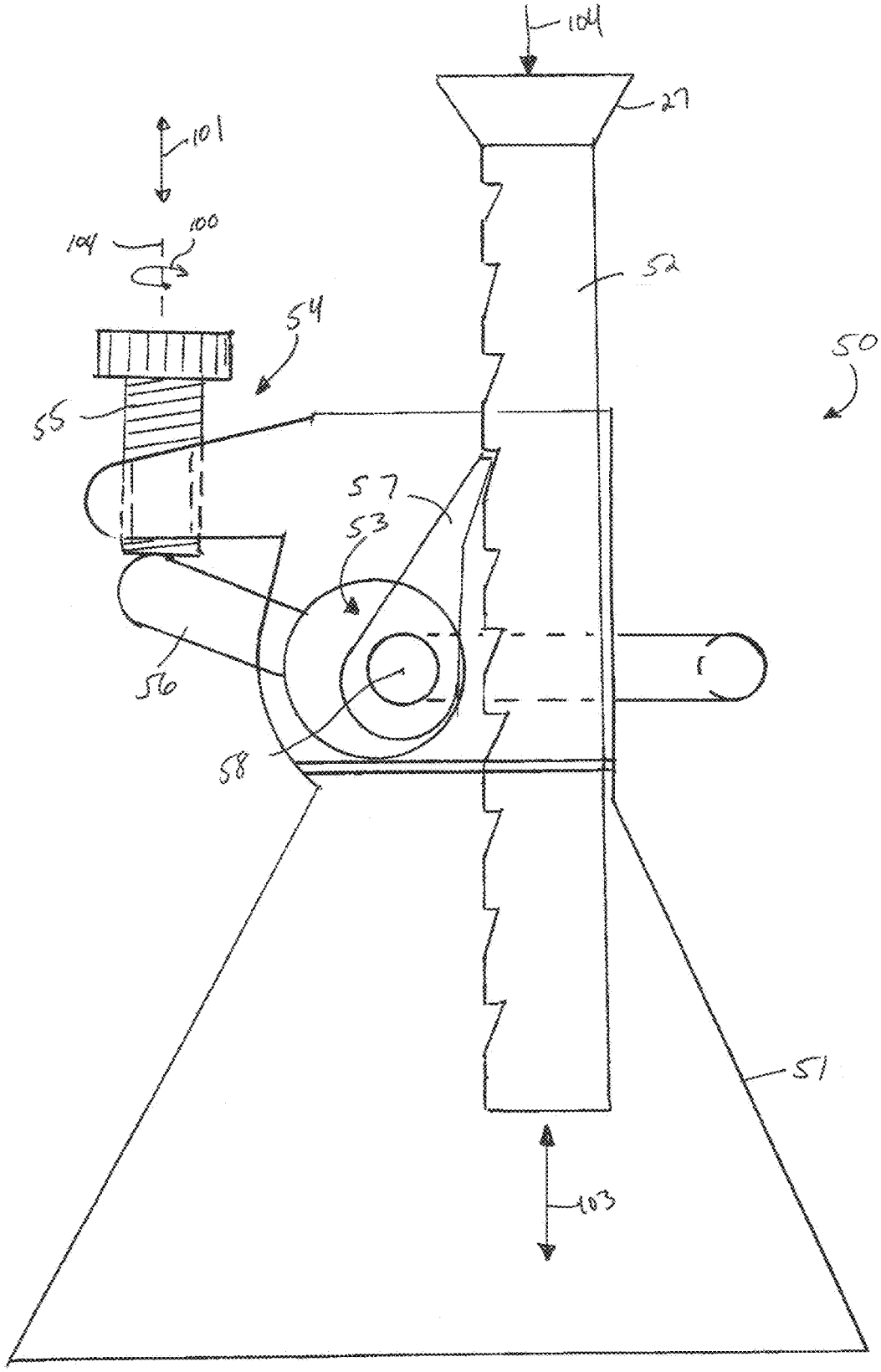
FIG. 8 is an elevational side diagrammatic depiction of a third alternative jack stand apparatus according to the present invention showing a third alternative screw mechanism in combination with a third alternative latch pawl assembly together being operable to enable the user to screw-adjust the third alternative latch pawl assembly via the third alternative screw mechanism to raise or lower a state of the art ratcheted support column or mast relative to a generic support base.

A third alternative jack stand apparatus 50 according to the present invention is generally depicted in FIG. 8. Jack stand apparatus 50 may be said to comprise a shaft support structure or base as at 51, a ratcheted shaft construction as at 52, a pawl assembly as at 53, and a screw assembly or mechanism as at 54. The screw assembly or mechanism 54 is operable to convert rotational motion 100 of the screw element 55 into linear motion 101 which is directed into a lever arm 56 of the pawl assembly 53 and thus into a pawl element 57 via a fulcrum 58. The linearly directed forced is thus transmitted into the shaft construction 52 for similarly and finely raising or lowering (as at 103) said shaft construction 52 into and out of engagement with an overlying load 104 as exemplified by the wheel-axle assembly 12.

It will be understood from an inspection of FIG. 8 that the screw mechanism or assembly 54 also operates to direct linear motion 101 into the lever arm 56 in a vertical direction, and does so via an internally threaded arm 59 that extends over or in superior adjacency to the lever arm 56. The screw axis of rotation as at 104 extends in parallel relation to the axis of the ratcheted shaft construction 52 and is cooperable with the internally threaded arm 59 that positions the screw axis of rotation 104 in adjacency to both the ratcheted shaft construction 52 and a portion of the lever arm 56 that operates to transmit force to the pawl element 57 via the fulcrum 58.

Figure 9:
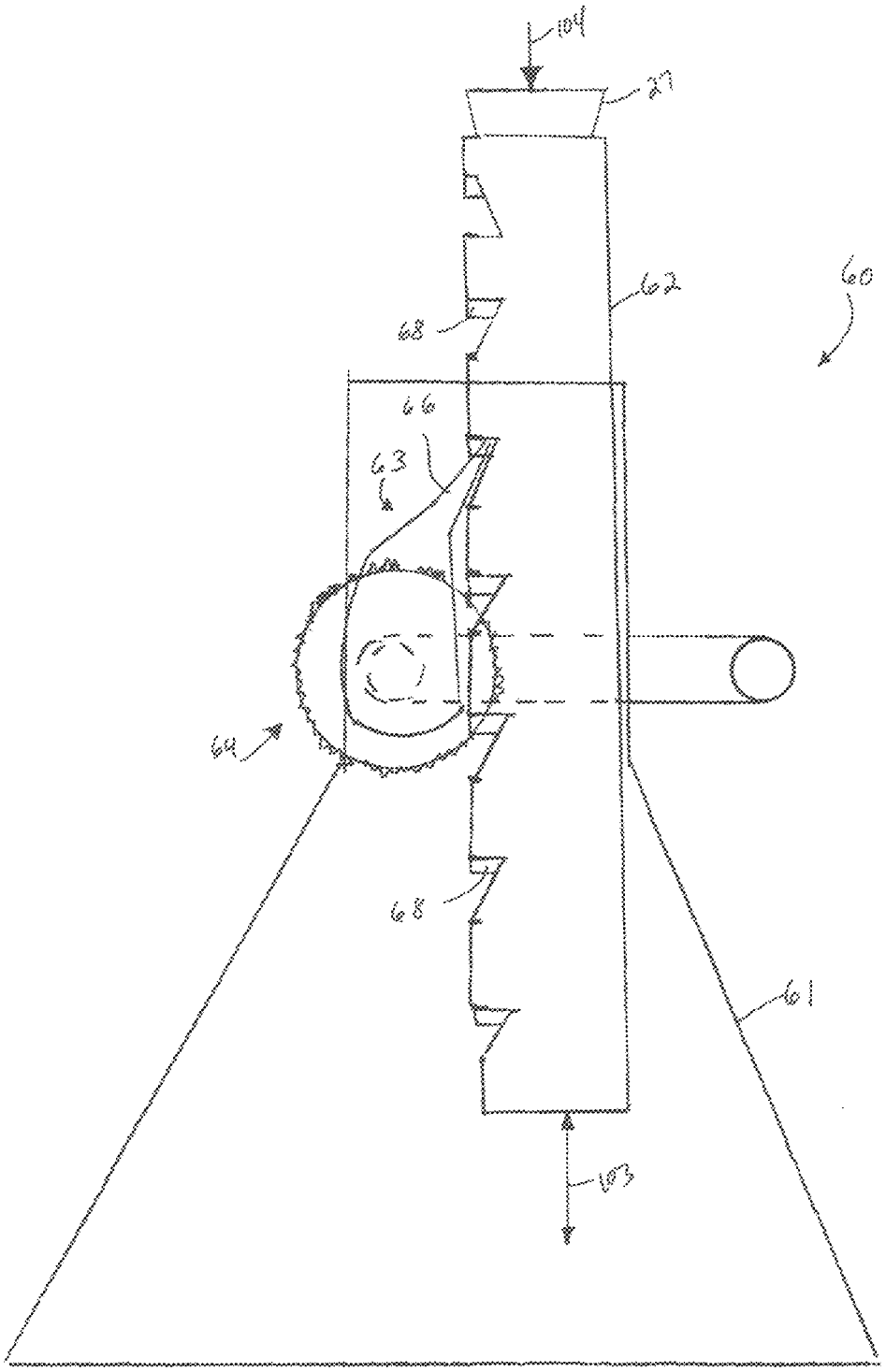
FIG. 9 is an elevational side diagrammatic depiction of a fourth alternative jack stand apparatus according to the present invention showing a further alternative mast or shaft support mechanism in combination with a further alternative latch pawl assembly together being operable to enable the user to screw-adjust said further alternative latch pawl assembly to raise or lower said alternative mast construction relative to a generic support base.
Figure 10:
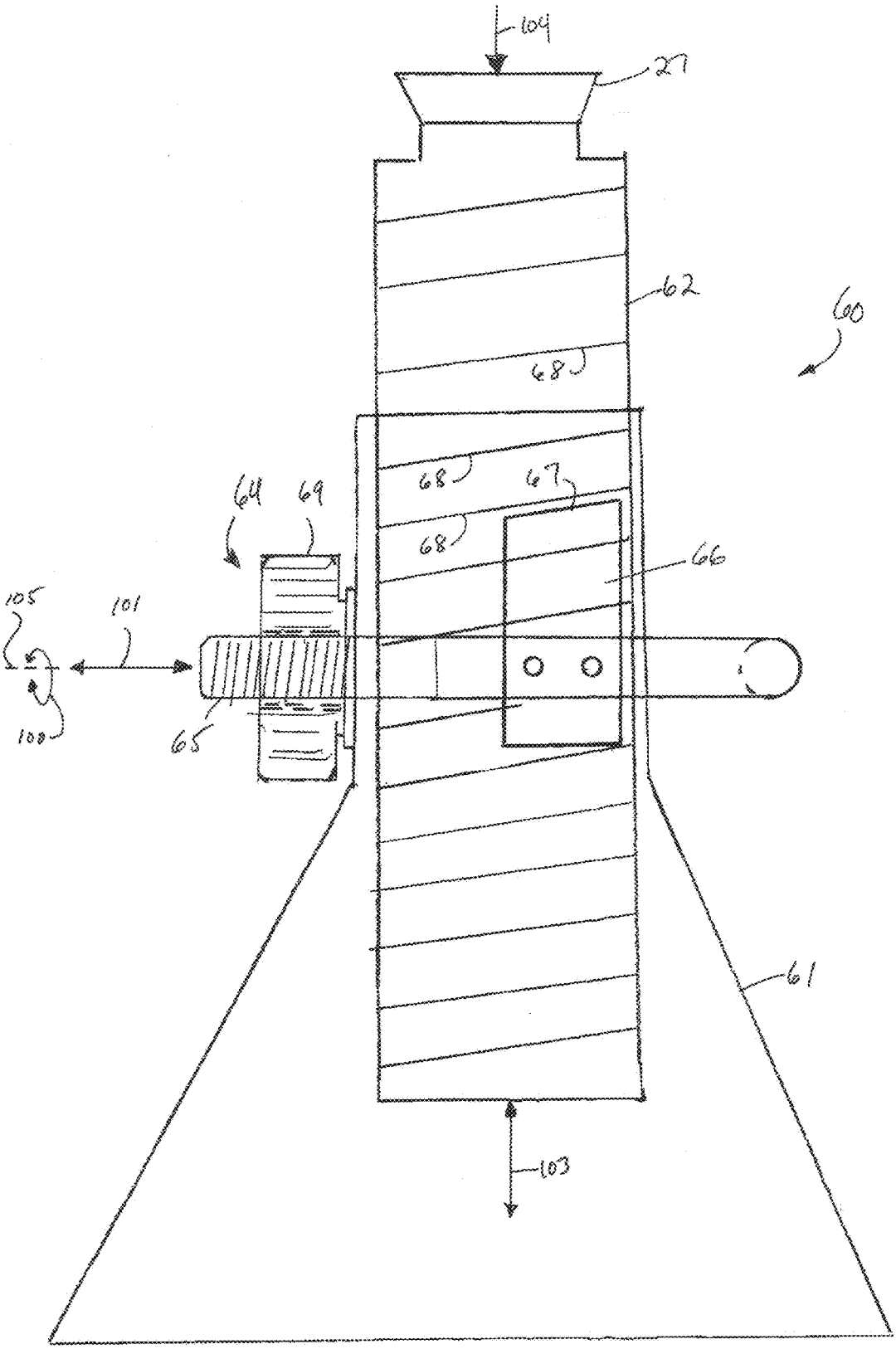
FIG. 10 is an elevational frontal diagrammatic depiction of the fourth alternative jack stand apparatus according to the present invention showing said alternative mast mechanism in combination with said alternative latch pawl assembly together being operable to enable the user to screw-adjust said alternative latch pawl assembly to raise or lower said alternative mast construction relative to the generic support base.

A fourth alternative jack stand apparatus 60 according to the present invention is generally depicted in FIGS. 9 and 10. Jack stand apparatus 60 may be said to comprise a shaft support structure or base as at 61, a ratcheted shaft construction as at 62, a pawl assembly as at 63, and a screw assembly or mechanism as at 64. The screw assembly or mechanism 64 is operable to convert rotational motion 100 of the screw element 65 into linear motion 101 which is directed into pawl element 66 of the pawl assembly 63 and into the shaft construction 62 via angled interfacing between the angled pawl tip 67 and angled interface structure 68 of the shaft construction 62 for similarly and finely raising or lowering (as at 103) said shaft construction 62 into and out of engagement with an overlying load 104 as exemplified by the wheel-axle assembly 12. It is to be understood that the angular relationship of the angled interfacing of the angled pawl tip 67 and angled interface structure 68 is relative to the horizontal.

It will be understood from a comparative inspection of FIGS. 9 and 10 that the screw mechanism or assembly 64 operates to direct linear motion 101 into the pawl element 66 in a horizontal direction, and does so via an internally threaded member 69 mounted in adjacency to the shaft construction 62 so as to effect a horizontal screw axis of rotation as at 105. The screw axis of rotation as at 105 extends in orthogonal relation to the axis of the ratcheted shaft construction 62. Thus the internally threaded member 69 positions the screw axis of rotation 105 such that when linear motion is directed into the angled pawl tip 67 of the pawl element 66, the angled interface structure 68 of the shaft construction 62 operates to finely adjust the shaft construction up or down as at 103 as needed.

While the above descriptions contain much specificity, this specificity should not be construed as limitations on the scope of the invention, but rather as an exemplification of the invention. For example, it is contemplated that the present invention may essentially be said to provide a jack stand apparatus having a screw-operable means for raising and lowering a shaft construction for finely raising and lowering said shaft construction into a load source for support a load via the shaft construction. Accordingly, although the inventive jack stand apparatus has been described by reference to a number of exemplary embodiments, it is not intended that the jack stand apparatus be limited thereby, but that modifications thereof are intended to be included as falling within the broad scope and spirit of the foregoing disclosure, the following claims, and the drawings, both diagrammatic and illustrative, submitted in support of these specifications.

I claim:

1. A jack stand apparatus for supporting an overlying load placed thereupon, the jack stand apparatus comprising:

a shaft support structure, the shaft support structure comprising a series of leg elements and a central shaft-receiving hub, the series of leg elements extending radially outwardly and downwardly relative to the central shaft-receiving hub, the central shaft-receiving hub comprising a shaft-receiving bore;

a screw shaft construction, the screw shaft construction being supported by the series of leg elements and the central shaft-receiving hub and rotatably received in the shaft-receiving bore of the central shaft-receiving hub of the shaft support structure, the screw shaft construction comprising a shaft axis of rotation and external helical threads, the external helical threads having a shaft thread pitch; and a pawl assembly, the pawl assembly comprising a fulcrum, a lever arm, and a pawl element, the lever arm and the pawl element extending from the fulcrum, the fulcrum having a fulcrum axis of rotation, the pawl element comprising a helical pawl tip, the helical pawl tip being structurally cooperable with the external helical threads and having a pawl pitch equal to the shaft thread pitch for enhancing structural cooperation between the pawl assembly and the screw shaft construction, the helical pawl tip comprising a flat pawl tip face, a helical upper pawl tip edge, a helical lower pawl tip edge, and laterally opposed pawl tip edges, the helical upper and lower pawl tip edges being parallel to one another, the laterally opposed pawl tip edges being parallel to one another, the fulcrum being cooperably associated with the shaft support structure for enabling a user to structurally cooperate the pawl tip with the external helical threads via the lever arm;

the screw shaft construction being telescopically positionable relative to the shaft support structure for engaging an the overlying load, the helical pawl tip being engagable with the external helical threads for preventing downward movement of the screw shaft construction relative to the shaft support structure when the helical pawl tip and the external helical threads are engaged, the series of leg elements for supporting the jack stand apparatus upon a support surface, the jack stand apparatus thus for supporting the overlying load placed thereupon.

2. The jack stand apparatus of claim 1 wherein the screw shaft construction is rotatable about the shaft axis of rotation, the helical pawl tip, engaged with the external helical threads, for converting rotational movement into linear movement of the screw shaft construction relative to the helical pawl tip for finely adjusting a length of exposed screw shaft construction relative to the shaft support structure for enhancing structural engagement with an overlying load interface.

3. The jack stand apparatus of claim 1 wherein the shaft support structure comprises opposed fulcrum support elements, the opposed fulcrum support elements extending outwardly from the central shaft-receiving hub between two leg elements of the series of leg elements, the opposed fulcrum support elements each comprising an arcuate outer fulcrum support element surface extending from an upper point of the central shaft-receiving hub in interior adjacency to an overlying load interface to a lower point of the central shaft-receiving hub intermediate a length of the two leg elements of the series of leg elements, the fulcrum being rotatably supported by the opposed fulcrum support elements equidistant intermediate the upper point of the central shaft-receiving hub and the lower point of the central shaft-receiving hub for enabling the user to structurally cooperate the helical pawl tip with the external helical threads via the lever arm.

4. The jack stand apparatus of claim 3 wherein the pawl element extends intermediate the opposed fulcrum support elements for enabling the user to structurally cooperate the helical pawl tip with the external helical threads via the lever arm.

5. The jack stand apparatus of claim 1 wherein the lever arm comprises an outer arm portion extending on an opposite side of the screw shaft construction relative to the pawl element, the outer arm portion comprising an arm weight for directing the helical pawl tip into engagement with the external helical threads.

6. The jack stand apparatus of claim 5 wherein the lever arm comprises parallel arm portions, the parallel arm portions extending on opposite sides of the fulcrum, the outer arm portion being a first parallel arm portion of the parallel arm portions and being spaced from the screw shaft construction a distance greater than an inner arm portion, the inner arm portion being a second parallel arm portion of the parallel arm portions.

7. The jack stand apparatus of claim 1 wherein the series of leg elements number three, the three leg elements for forming a tripod type arrangement for enhancing support and maintaining stability of the overlying load placed thereupon.

* * * * *